United States Patent [19]

Britton et al.

[11] 4,204,921

[45] May 27, 1980

[54] METHOD FOR REJUVENATING CHLOR-ALKALI CELLS

[75] Inventors: Wayne E. Britton, Plano, Tex.; Michael Krumpelt, Naperville, Ill.

[73] Assignee: BASF Wyandotte Corporation, Wyandotte, Mich.

[21] Appl. No.: 21,354

[22] Filed: Mar. 19, 1979

[51] Int. Cl.[2] ..... C25B 1/26; C25B 1/16

[52] U.S. Cl. ..... 204/98; 204/128

[58] Field of Search ..... 204/98, 128

[56] References Cited

U.S. PATENT DOCUMENTS 4,040,919 8/1977 Eng ..... 204/98

4,118,308 10/1978 Specht ..... 204/98

*Primary Examiner*—R. L. Andrews

*Attorney, Agent, or Firm*—John W. Linkhauer; Joseph D. Michaels

[57] ABSTRACT

Deposits of alkali metal ions such as calcium and magnesium on chlor-alkali cathodes and diaphragms are removed by feeding an acid such as hydrochloric acid into the cathode feed in an amount sufficient to reduce the pH below 8 for a time sufficient to remove these deposits and restore the cell to normal operation. The use of this invention allows one to use relatively high hardness water as the cathode feed solution during normal operation of a membrane chlor-alkali cell.

4 Claims, No Drawings

METHOD FOR REJUVENATING CHLOR-ALKALI CELLS

BACKGROUND OF THE INVENTION

1. Field of the Invention

The present invention relates to a method of rejuvenating chlor-alkali cells, and more particularly it relates to rejuvenating the cathodes of chlor-alkali cells having a membrane separating the cell into distinct anolyte and catholyte compartments.

2. Description of the Prior Art

The production of chlorine and caustic from brine by electrolysis is well known and is an important commercial process. In general, the process was either carried out with a group of mercury cells, or with the use of permeable diaphragms such as asbestos diaphragms. A recent development is the use of an ion exchange membrane in place of the permeable diaphragms. It is to the latest type of cells having membrane separators that the present invention pertains.

In the prior art diaphragm cells, one solution, generally saturated sodium chloride solution, is flowed first into the anode compartment and then through the porous diaphragm into the cathode compartment of the cell. This operation requires only one solution feed, and therefore a purification of only one solution is necessary. By purification, it is meant the removal of calcium and magnesium ions in the feed solution, and this purification was generally considered necessary for efficient cell operation. In the new technology which utilizes a membrane as a separator between the anode compartment and the cathode compartment, a separate anolyte solution and a catholyte solution of different chemical makeup is required. In other words, sodium chloride is still fed into the anode compartment, but water is generally fed into the cathode compartment.

It is well known that calcium and magnesium ions can form insoluble materials in diaphragms and membranes and therefore such ions in the anolte solution now are a source of a rather serious problem in this type of electrolytic cell. However, calcium and magnesium ions in the cathode compartment have not been considered serious in this respect because they tend to migrate toward the cathode rather than toward the membrane.

Accordingly, the prior art contains considerable technology for rejuvenating diaphragms and for handling the plugging problem caused by calcium and magnesium ions. For example, U.S. Pat. No. 1,309,214 mentions withdrawing electrolyte, and washing the cell with acid such as lactic acid so as to remove the calcium and magnesium from the cell. U.S. Pat. No. 3,467,586 teaches a method for rejuvenating asbestos diaphragms by washing with strong acid until the solution passing through the diaphragm is below ph 8. The procedure calls for draining the cathode compartment, and although acid reaches the cathode chamber, it is not clear whether the acid completely washes the cathode surface or not. These processes also have the disadvantage of requiring cell shut down during the rejuvenating procedure. U.S. Pat. No. 3,220,946, which shows a three compartment cell, mentions adding acid to the middle or buffer compartment to prevent back migration of hydroxyl ion. However, the catholyte is not acid and acid doesn't reach the cathode.

These techniques have also been utilized to rejuvenate the membranes in membrane cells, and U.S. Pat. No. 4,040,919 calls for the addition of hydrochloric acid to the anolyte and water to the buffer or catholyte to decrease the pH in the cathode compartment. However, the pH of the cathode compartment is still strongly alkaline. U.S. Pat. No. 4,115,218 discloses a method of electrolyzing brine wherein the membrane is purified by periodically reducing the electric current and flooding the cathode compartment. However, this process requires that the water utilized be rather highly purified by substantially complete removal of calcium and magnesium ions.

SUMMARY OF THE INVENTION

The primary object of the present invention is to provide a process for rejuvenating membrane type electrolytic cells having a separate anolyte feed and catholyte feed. It has been found that this rejuvenation requires not only removal of calcium and magnesium deposits from the membrane, but also the removal of calcium and magnesium deposits from the cathode surface itself. The invention also provides a process wherein the cell may be kept under full operating conditions, if desired; or, if desired, the operating current may be reduced or discontinued during the rejuvenating process. Another advantage of the invention resides in the fact that the rejuvenating process allows for the use of feed solutions which have not had to undergo extensive treatment to remove calcium and magnesium ions therefrom.

In accordance with the invention, a chlor-alkali cell having an anode, a cathode and a membrane separating the cell into an anolyte compartment and a catholyte compartment, and wherein the cell efficiency is reduced by buildup of deposits containing calcium and magnesium, is rejuvenated by a method comprising the step of adding an acid to the catholyte compartment in an amount sufficient to reduce the pH of the catholyte below pH 8, said acid having an anion of the class which forms soluble salts with both calcium and magnesium. Preferably, the acid utilized is hydrochloric acid, since this acid does not add any ions to the system which are not already present, and is best used for continued cell operation.

DESCRIPTION OF THE PREFERRED EMBODIMENTS

With the development of the dimensionally stable anode such as that shown in U.S. Pat. No. 3,682,498, there has been increased interest in the use of electrolytic cells having separators such as diaphragms or membranes. In addition, certain improvements have been made with respect to the cathodes used in such cells such as the plasma sprayed nickel cathodes described in U.S. Pat. No. 4,049,841. In addition, considerable interest is now being displayed in the use of a membrane as a separator instead of the conventional diaphragms such as asbestos fibers, which have been used for years.

Typical membranes which are suitable are generally made of the copolymer of tetrafluoroethylene and perfluorovinylether sulfonylfluoride having an equivalent weight of 1350, such as material commercially available as "Nafion" resin. However, any suitable membrane may be used in practicing the present invention.

The usual operation of the cell using the membrane, however, differs from that using the typical diaphragm. For example, it is customary to feed diaphragm cells by adding brine to the cathode compartment with a hydrostatic head provided so that water and sodium ions feed through the diaphragm into the cathode compartment. In addition, chloride ions also move through the diaphragm so that the product caustic also contains a certain amount of salt. With the membrane cells, it is customary to feed pure water to the cathode compartment while feeding brine to the anode compartment, sodium ions migrate through the diaphragm, but migration of chloride ions is minimized and a relatively salt-free caustic is produced in the cathode compartment. This operation also eliminates the need for a head of anolyte to force liquid through the diaphragm.

It has also been customary to purify the brine solution in order to remove calcium and magnesium ions therefrom since these ions tend to combine with hydroxyl ions at the diaphragm or membrane, which hydroxyl ions are polarized back toward the anode. This causes blocking of the diaphragm or membrane and requires removal of calcium deposits from time to time.

It has now been found, that in membrane type cells, particularly, where water is added to the cathode compartment, the cathodes tend to build up a film of material that causes an inefficient operation after a period of time. In general, purification of the water being introduced as cathode feed has been considered unnecessary since the calcium and magnesium ions tend to migrate toward the cathode rather than toward the membrane. However, we have discovered that a cathode feed solution containing magnesium ions will form a white precipitate of magnesium hydroxide on the cathode surface. This precipitate impedes mass transport to the surface of the electrode. We have found that this precipitate increases the total cell voltage and also increases the half cell voltage of the cathode reaction. This voltage increase is undesirable, but purifying the catholyte feed solution is costly. In addition, even efficient purification methods leave ions in solution and after long periods of time, these low concentrations of ions will build up on the cathode in any event. Thus, in accordance with the invention, a method of removing the magnesium ion and other interfering ions such as iron from the cathode have been developed. In addition, this treatment also assists in rejuvenating the membrane while at the same time rejuvenating the cathode surface. Thus, when utilizing the present invention, costly purification of both the anolyte feed and catholyte feed are rendered unnecessary.

We have now discovered that removing these insoluble impurities, such as calcium, magnesium and iron, is much more effective by slowly metering acid into the cathode solution so that the effluent becomes acidic. The acid quickly dissolves the precipitates and washes them from the cell. Preferably, the cell remains at full current while the acid is metered into the cell. However, it will be appreciated that the cell could be operated at less than full current or even shut down altogether, if desired. The rate and amount of acid required will depend upon a number of factors when operating at full current, such as the cell size and geometry, cathode flow rate and the concentration of the impurities, but it is not restricted to these factors.

Magnesium hydroxide deposited on a cathode does not become appreciably soluble until the pH is reduced to at least 8, but at very low pH values, such as below pH 1, corrosion of the cathode can take place. The preferred range is pH 2 to 7. This can be attained most easily by measuring the effluent pH while adjusting the acid feed rate. However, it is preferable to calculate the acid requirement based upon the current and flow rate. Thus, at 25 amperes and a water flow rate of 200 milliliters per hour, the caustic produced would be 3.5 mole at 100 percent current efficiency. To exactly compensate for this, one would have to feed the cell 3.5 molar HCl at 200 milliliters per hour which would form an aqueous sodium chloride solution near pH 7.

In general, any acid may be utilized that would form soluble salts with calcium and magnesium such as lactic acid. However, hydrochloric acid is preferred because it introduces no ions into the system that are not already present. As mentioned above, the use of hydrochloric acid produces sodium chloride in the catholyte and this can be separated by any of the known techniques. In addition, the catholyte containing strong concentrations of sodium chloride can be diverted from the product caustic, if desired. One of the advantages of the present invention is the provision that the cell is maintained under operating conditions during the rejuvenating process. In this way, the anolyte and catholyte are retained with electrolytic substances, the membrane is maintained in operating conditions, and the cell is easily returned to normal operation. As indicated above, although the present invention is directed primarily to removing magnesium hydroxide from cathodes, an operation which heretofore has not been described to our knowledge, it also provides for removal of calcium and like deposits from the membrane. In addition, it will be appreciated that other materials such as iron, tend to accumulate on the cathode and reduce the efficiency thereof. Accordingly, the process is directed to the removal of any of these ions present in the catholyte feed water that would tend to reduce the efficiency of the cathode after build up and which need to be removed.

The invention is further described by the following specific examples, which are intended to be illustrative only and not to be construed as limiting the invention.

EXAMPLE 1

A laboratory scale chlor-alkali membrane cell housing a three inch by six inch steel cathode and a three inch by six inch dimensionally stable anode comprised of ruthenium dioxide and titanium separated by a sulfonated perfluorocarbon ion exchange membrane was utilized for the purpose of electrolyzing sodium chloride brine to produce chlorine and reducing water to produce caustic and hydrogen. This cell was operated for 413 days using the tap water with typically 30 parts per million hardness as a cathode feed solution. The feed rate was 125 milliliters per hour yielding a sodium hydroxide of 5.2 molar concentration. The initial potential of the cell had been 3.3 volts but had increased to 3.75 volts at the end of 413 days. The cathode had a cell potential of 1.48 volts versus a saturated calomel reference. A normal HCl solution was added to the cathode feed solution for two and a half hours at the rate of 100 milliliters per hour during which time the pH fell from 14 to 1. This condition was maintained for 30 minutes and a yellow discoloration was noted in the solution. The colored component proved to be ferric hydroxide (20 parts per million, analysis by thioglycolic acid method). After returning to normal water feed, the cell voltage was 3.38 volts and the half cell potential was down to 1.41 volts. After disassembling the cell, it was noted that much of the coating had been removed.

EXAMPLE 2

A chlor-alkali membrane cell similar to that of Example 1 was operated for 85 days with demineralized water as the cathode feed. Then, in order to increase the amount of magnesium ion for testing purposes, the cathode feed solution was spiked with 100 parts per million of magnesium chloride for 25 days. During this addition, the voltage rose from 3.66 volts at 5 normal caustic to 4.0 volts. At this time, the cathode was fed a 5 molar hydrochloric acid solution and the effluent was monitored for iron concentration and magnesium concentration as a function of time. The pH stayed between 3 and 8 and the acid flow was maintained for four hours. The data are recorded in the Table below. The cell voltage dropped 4.0 to 3.7 volts after the acid addition.

Table

| Time from Beginning of acid feed (hrs) | Effluent Values | | |
|---|---|---|---|
| | pH | iron (ppm) | Mg (ppm) |
| 0 | 14 | 0 | 0 |
| 0.5 | 14 | 0 | 0 |
| 1.0 | 14 | 0 | 0 |
| 1.5 | 14 | 0 | 0 |
| 2.0 | 14 | 0 | 0 |
| 2.5 | 8 | 0 | 60 |
| 3.0 | 4 | 0 | 80,000 |
| 3.5 | 3 | 2 | 7,000 |
| 4.0 | 3 | 5 | 100 |

From the foregoing description, it is seen we have provided a method of rejuvenating membrane type chlor-alkali cells, and in particular, rejuvenating the operative cathode surfaces thereof. It is also seen that the rejuvenation may be accomplished without shutting down the cell.

The embodiments in which an exclusive property or privilege is claimed are as follows:

1. In a chlor-alkali cell having an anode, a cathode and a membrane separating the cell into an anolyte compartment and a catholyte compartment, and wherein cell efficiency is reduced by build-up of deposits containing calcium and magnesium, a method of rejuvenating the cell and cathode comprising the step of adding an acid to the catholyte compartment in an amount sufficient to reduce the pH of the catholyte below pH 8, said acid having an anion of the class which forms soluble salts with both calcium and magnesium, the cell current being maintained at the normal operating level while the acid is added to the catholyte chamber.

2. The process defined in claim 1, wherein the catholyte is retained at a pH below 8 until the cell voltage is reduced to a substantially constant value.

3. In a chlor-alkali cell having an anode, a cathode and a member separating the cell into an anolyte compartment and a catholyte compartment, and wherein cell energy efficiency is reduced by build-up of deposits containing calcium and magnesium, a method of rejuvenating the cell comprising the step of adding hydrochloric acid to the catholyte compartment in an amount sufficient to reduce the pH below about 8, the cell current being maintained at the normal operating level while the acid is added to the catholyte chamber.

4. The process defined in claim 3, wherein the catholyte is retained at a pH below 8 until the cell voltage is reduced to a substantially constant value.

* * * * *